US011654594B2

(12) United States Patent
Slavinski et al.

(10) Patent No.: US 11,654,594 B2
(45) Date of Patent: May 23, 2023

(54) METHOD AND SYSTEM FOR DEMOLDING A FLEXIBLE MOLD OF DRIED WET-CAST CONCRETE PRODUCTS

(71) Applicants: Slab Innovation Inc., Saint-Hubert (CA); Les Pierres Royales, Varennes (CA)

(72) Inventors: Benoit Slavinski, St-Basile-le-Grand (CA); Maxime Chevrier, St-Michel (CA); Ludovic Legendre, Montreal (CA); Dominique Vézina, Carignan (CA)

(73) Assignees: Slab Innovation Inc., Saint-Hubert (CA); Les Pierres Royales, Varennes (CA)

( * ) Notice: Subject to any disclaimer, the term of this patent is extended or adjusted under 35 U.S.C. 154(b) by 374 days.

(21) Appl. No.: 16/794,615

(22) Filed: Feb. 19, 2020

(65) Prior Publication Data

US 2021/0252740 A1 Aug. 19, 2021

(51) Int. Cl.

| | |
|---|---|
| ***B28B 13/06*** | (2006.01) |
| ***B28B 7/06*** | (2006.01) |
| ***B28B 7/34*** | (2006.01) |
| ***B28B 15/00*** | (2006.01) |

(52) U.S. Cl.

CPC ..... *B28B 13/062* (2013.01); *B28B 7/06* (2013.01); *B28B 7/348* (2013.01); *B28B 15/00* (2013.01)

(58) Field of Classification Search

CPC ..... B28B 13/062; B28B 13/06; B28B 7/06; B28B 7/08

See application file for complete search history.

(56) References Cited

U.S. PATENT DOCUMENTS

| | | | | |
|---|---|---|---|---|
| 7,887,317 | B1 * | 2/2011 | Barrett, Jr. | B28B 13/062 425/440 |
| 8,911,224 | B2 * | 12/2014 | Correia | B28B 13/062 249/127 |
| 2007/0228613 | A1 | 10/2007 | Plourde et al. | |
| 2018/0111289 | A1 * | 4/2018 | Savorelli | B28B 13/062 |

FOREIGN PATENT DOCUMENTS

ZA 2011/01114 B 2/2011

OTHER PUBLICATIONS http://www.automacad.com/ConcreteIndustry/WetCast-5/Demolding-44/.
https://www.youtube.com/watch?v=6_-BVA57Qnl.
https://www.youtube.com/watch?v=ErdY_0cVhhk&t=328s.
https://www.youtube.com/watch?v=Chjr9SLwkUM.

* cited by examiner

*Primary Examiner* — Kelly M Gambetta
*Assistant Examiner* — Virak Nguon
(74) *Attorney, Agent, or Firm* — Agence de Brevets Fournier

(57) ABSTRACT

The problem of wet-cast concrete products getting stuck or being uncontrollably ejected from a flexible mold during demolding is solved by moving the flexible mold through a passage, defined by both a mold-receiving surface and a rotatable mold-support distanced therefrom, while moving an edge of the flexible mold along an unsmooth path that includes at least one sharp point.

7 Claims, 13 Drawing Sheets

METHOD AND SYSTEM FOR DEMOLDING A FLEXIBLE MOLD OF DRIED WET-CAST CONCRETE PRODUCTS

FIELD

The present disclosure concerns concrete molded products manufacturing. More specifically, the present disclosure is concerned with a method and system for demolding a flexible mold of dried wet-cast concrete products.

BACKGROUND

Precast concrete is a well-known construction product produced by casting concrete in a reusable mold or "form", which is then cured in a controlled environment. There are mainly two common methods of manufacturing precast concrete products: the dry-cast method and the wet-cast method. Both methods create a simulated natural cut stone look and are used in manufacturing a variety of products such as: paving stones, bricks, veneer bricks, retaining wall bricks, steppingstones, etc.

As its name would imply, wet-cast concrete is more liquid. It has a high slump, which gives it the ability to be poured from a mixer or hopper. Also, in wet-cast a rubber mold is used. In contrast, dry-cast concrete is very dry, has zero or near-zero slump, and the forms can be stripped as soon as the concrete has been consolidated.

The dry cast manufacturing process typically involves complex machinery. Dry-cast concrete contains only enough water to hydrate the cement. The mix is compressed in a mold with very high pressure and then cured on a rack before being palletized and processed.

To manufacture wet-cast products, concrete is poured into a flexible mold and then vibrated to release air bubbles out of the mix. The mold then gets stripped after the concrete has cured.

De-molding in wet-cast is usually done by raising the mold, face-down, from a table or conveyor, or by peeling the mold.

Automated systems and methods are known for peeling the mold, all including includes gripping an edge of the mold and moving it along an arcuate path away from the mold-receiving table, thereby forcing by gravity the dried concrete products therein to remain onto the table. Such known arcuate paths ranges from small arcs to semi-circle.

While such de-molding processes work fine with sufficiently large and heavy products, which simply stays on the table while the mold is removed, it has been found that smaller products get stuck in the mold.

This is caused by the concrete creating a vacuum on the mold, resulting in a tight connection between the products and the mold.

Another drawback of known automated methods and systems is that the demolding movement along a smooth path has been found to cause uncontrolled ejection or stucking of the products in cases of differently sized products in a same mold or depending on the geometry of the products.

It results that current automatic demolding of wet-cast concrete products, especially of relatively small products or of differently sized products in a same mold still requires extra labor and causes some of the products to broke when they uncontrollably fall from the mold.

A demolding method and system that is free of the above drawback is therefore desirable.

SUMMARY

The problem of wet-cast concrete products getting stuck or being uncontrollably ejected from a flexible mold during demolding is solved by moving the flexible mold through a passage, defined by both a mold-receiving surface and a rotatable mold-support distanced therefrom, while moving an edge of the flexible mold along an unsmooth path that includes at least one sharp point.

According to an illustrative embodiment, there is provided a method for demolding at least one flexible mold that is at least partially filled with dried wet-cast concrete products and that has a peripheral edge; the method comprising:

providing a table and a mold-support member so distanced from the table as to define a passage for the at least one flexible mold therethrough; the mold-support member being rotatable about an axis parallel to the passage to minimize friction in the passage;

receiving the at least one flexible mold on the table so that a portion of the peripheral edge extends out of the passage; and moving the at least one flexible mold through the passage while moving the portion of the peripheral edge along an unsmooth path about the mold-support member; the unsmooth path including at least one sharp point.

According to another illustrative embodiment, there is provided a system for demolding at least one flexible mold that is at least partially filled with dried wet-cast concrete products and that has a peripheral edge, the system comprising:

a table defining a surface for receiving the at least one flexible mold thereon;

a mold-support member mounted to the table; the mold-support member being so distanced from the surface as to define a passage for the at least one flexible mold therethrough; the mold-support member being rotatable about an axis parallel to the passage to minimize friction in the passage; and a mold-moving system including i) a mold-prehension mechanism that is adapted for gripping a portion of the peripheral edge of the at least one flexible mold and ii) a guiding system coupled to the mold-prehension mechanism for moving the mold-prehension mechanism along an unsmooth path about the mold-support member; the unsmooth path including at least one sharp point.

According to still another illustrative embodiment, there is provided a system for demolding at least one flexible mold that is at least partially filled with dried wet-cast concrete products and that has a peripheral edge, the system comprising:

a conveyor defining a surface for receiving the at least one flexible mold thereon;

a cylindrical rod mounted to the table; the cylindrical rod being so distanced from the surface as to define a passage for the at least one flexible mold therethrough; the cylindrical rod rotatable about an axis parallel to the passage to minimize friction in the passage; and a mold-moving system including i) a gripping tool that is adapted for gripping a portion of the peripheral edge of the at least one flexible mold and ii) a robot arm for moving the gripping along an unsmooth path about the cylindrical rod; the unsmooth path including at least one sharp point The action of removing the vacuum on a flexible mold having dried wet-cast concrete products therein will be referred to in the description and in the claims as 'cracking'.

Other objects, advantages and features of embodiments of a method and system for demolding a flexible mold of dried wet-cast concrete products will become more apparent upon reading the following non-restrictive description of preferred embodiments thereof, given by way of example only with reference to the accompanying drawings.

BRIEF DESCRIPTION OF THE DRAWINGS

In the appended drawings:

FIGS. 1A-1D are top perspectives of a system for demolding a flexible mold of dried wet-cast concrete products according to a first illustrative embodiment, further illustrating the operation thereof;

FIGS. 3A-3D are side elevations of the system from FIG. 1, illustrating from another point of view the operational steps from FIGS. 1A-1D;

DETAILED DESCRIPTION

Figure 1A:
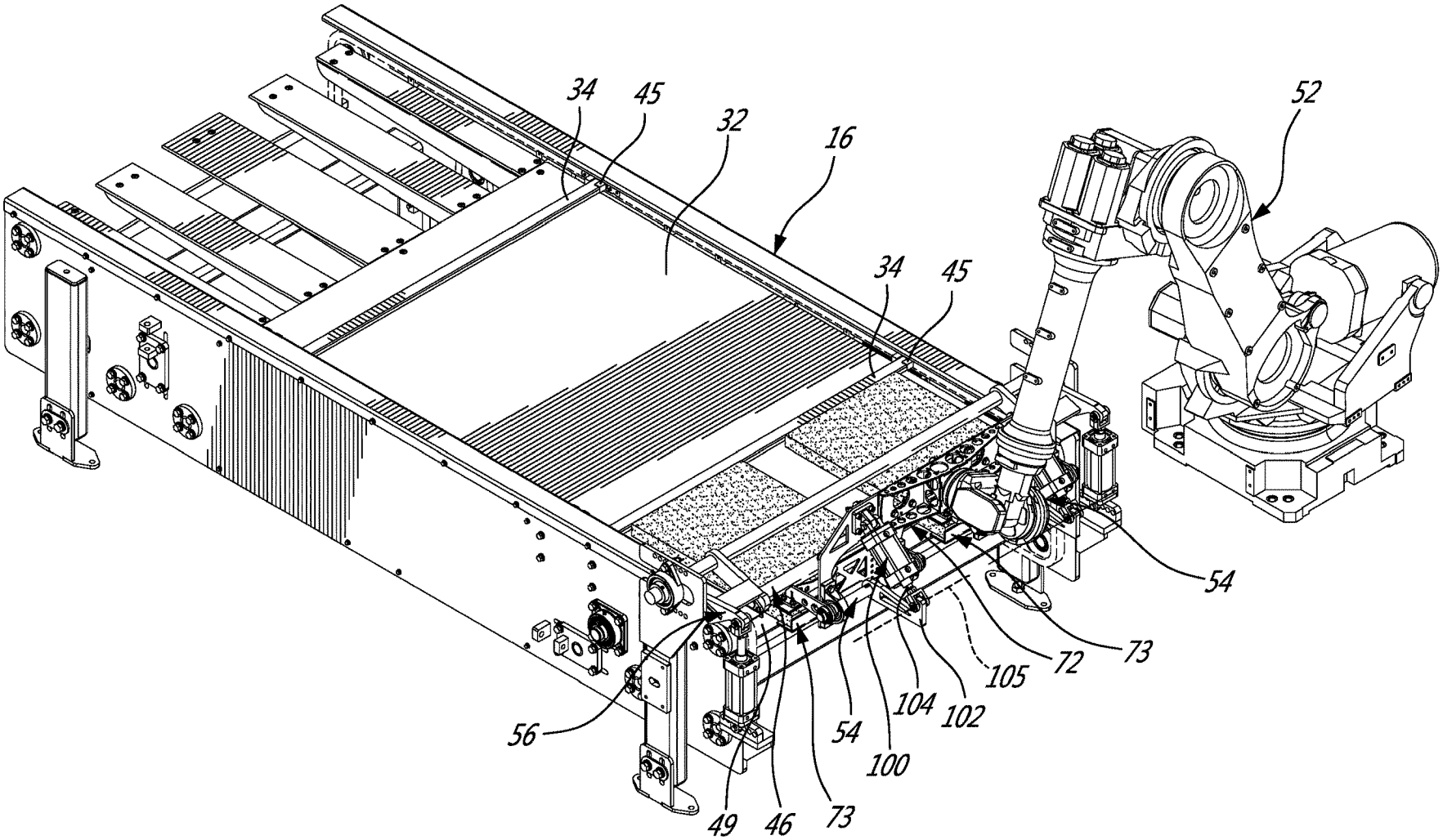
Figure 1B:
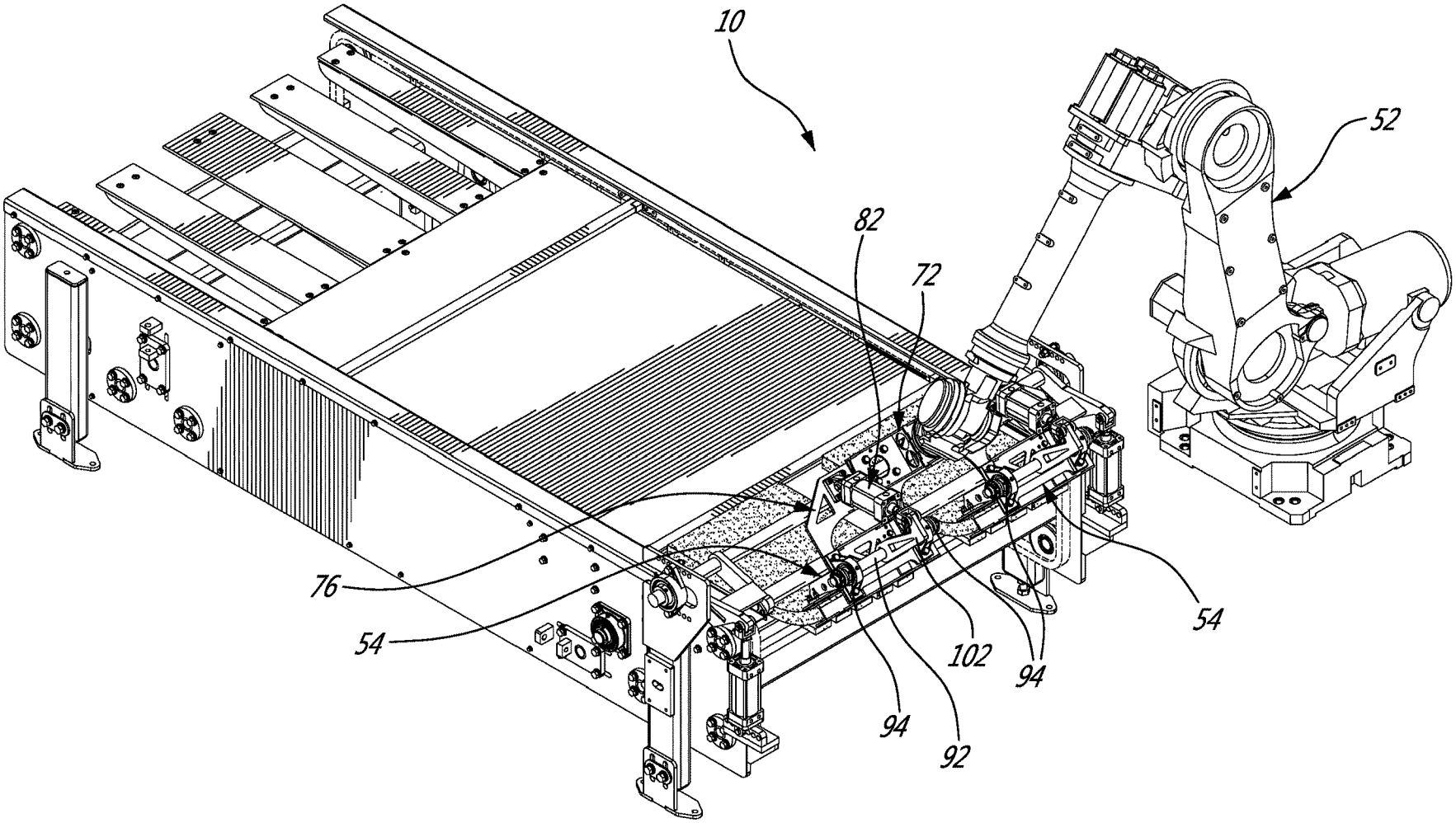

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

A system 10 for demolding a flexible mold 12 of dried wet-cast concrete products 14 according to a first illustrative embodiment will now be described with reference to FIGS. 1A-1D and 3A-3D. As can be seen for example in FIG. 1A, the system 10 is configured to demold two (2) molds 12 at the same time. As can become more apparent upon reading the following description, the system 10 can be adapted to simultaneously receive and demold any number of molds 12.

Figure 4:
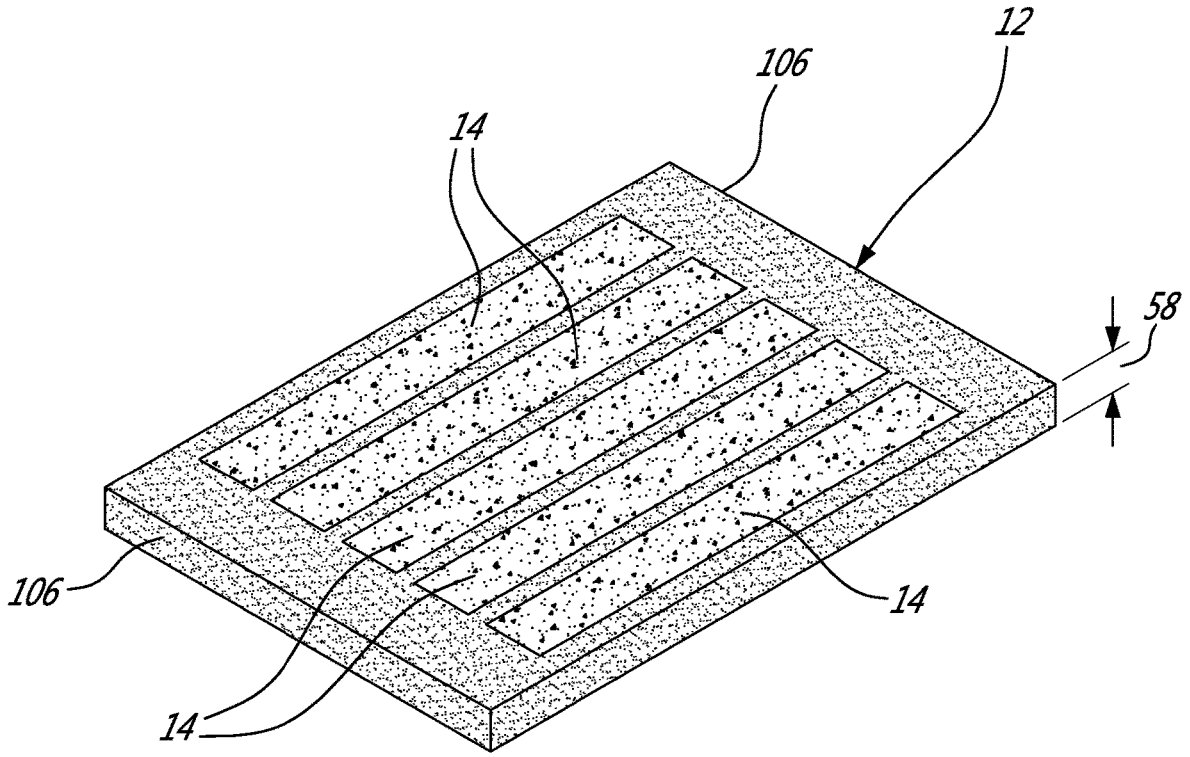
FIG. 4 is an isolated perspective of a flexible mold of dried wet-cast concrete products shown for example in FIGS. 1A-1D.

One of the molds 12, prior to demolding, and therefore with dried wet-cast products 14 therein, is shown in FIG. 4.

The mold is made of rubber, polyurethane, or of another flexible material.

While the illustrated products are in the form of five (5) identical elongated bricks 14, the system 10 can be used for demolding a flexible mold including a various number of identical or of differently shaped products.

The system 10 is integrated to a conveyor 16 for the molds 12.

Figure 2:
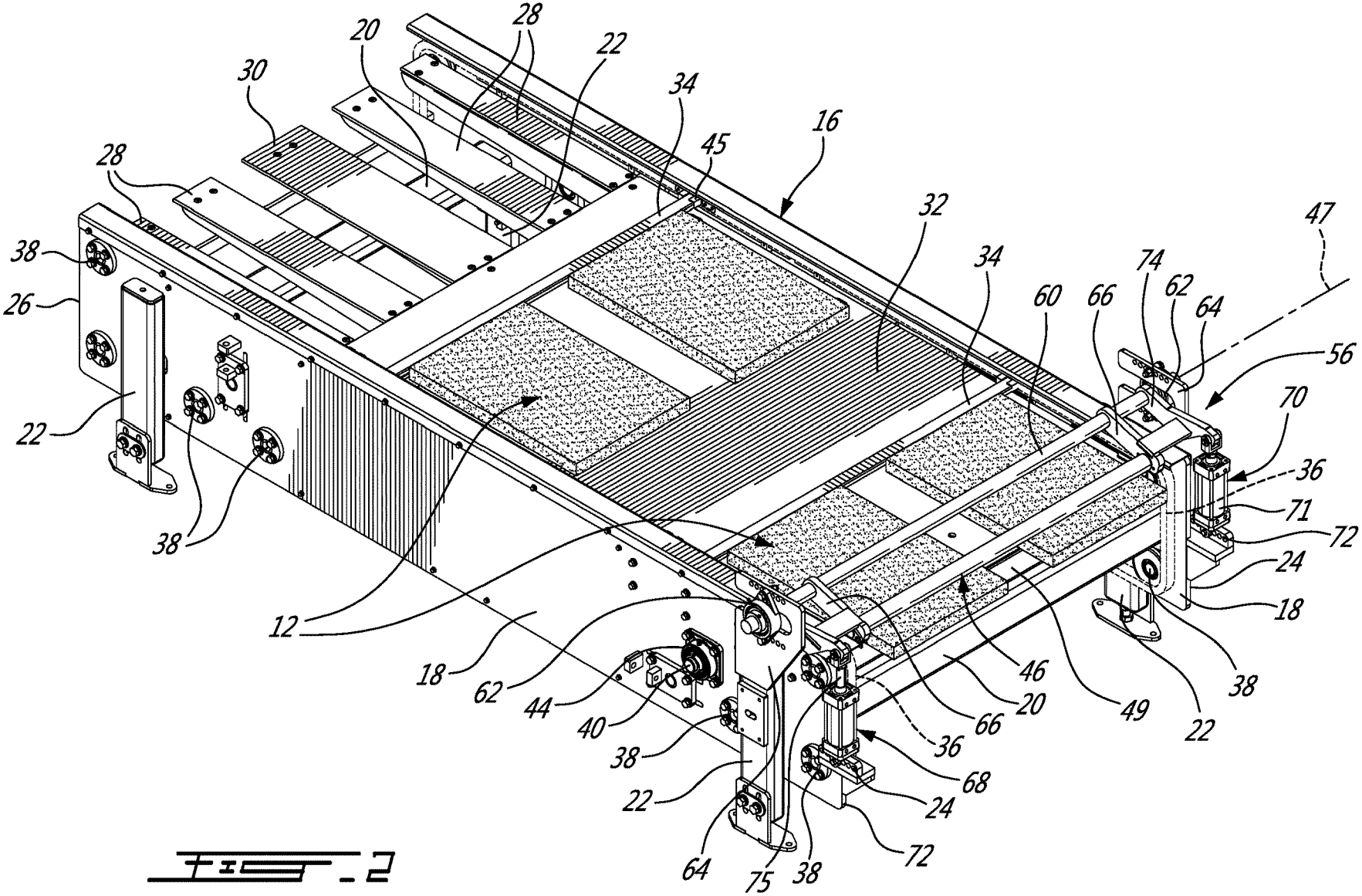
FIG. 2 is an isolated top perspective of a conveyor, part of the system from FIG. 1.

Turning now briefly to FIG. 2, the conveyor 16 is a pusher bar type conveyor that comprises a table defined by two elongated side plates 18 joined by a series of parallel transversal 20 shafts (only two shown), two pairs of legs 22, each secured to a respective plate 18 near the longitudinal ends 24 and 26 thereof, and a conveying surface, defined on a first third of the table by a series of parallel longitudinal frame elements 28-30 and by a rectangular plate 32 that extends through the remaining surface of the table.

The conveyor 16 further comprises a product-conveying mechanism including pusher bars 34 (only two shown) that are mounted to the table for movement along a closed loop path around the table that passes in close proximity to the conveying surface.

The product-conveying mechanism includes i) two strands of roller chains 36 (shown schematically in FIGS. 1A-1D by dashed lines), each one mounted on a respective plate 18, on the inner side thereof, in a close loop fashion via a series of pulleys 38, ii) a drive shaft 40 mounted to both plates 18 therebetween and a iii) motor (not shown) operatively coupled to the drive shaft 40. Each roller chain 36 is coupled to the drive shaft 40 via a driving pulley 44.

Each of the pusher bars 34 is secured to both strands of roller chains 36 therebetween via mounting brackets 45.

The table, the conveying surface and the product-conveying mechanism are not limited to the illustrated embodiment, and can be adapted, for example, to the configuration of the mold 12. Since pusher-bar conveyors are believed to be well-known in the art, the conveyor 16 will not be described herein in more detail.

According to another embodiment (not shown), the system 10 is integrated to another type of conveyor, such as, without limitations, a belt conveyor.

In addition to the table of the conveyor 16, the system 10 for demolding flexible molds 12 comprises a support member 46, in the form of a cylindrical rod, mounted to the conveyor 16, and a mold-moving system 50 in the form of a robot 52 equipped with a pair of gripping tools 54.

The cylindrical rod 46 is mounted to the conveyor 16 for pivotal movements, about the axis 47, towards and away the conveying surface defined by the plate 32 via a mounting assembly 56. This allows for an adjustment of the distance of the member 46 to the plate 32 depending on the thickness 58 of the molds 16 or of the pressure of the member 46 thereon.

As will be described hereinbelow in more detail, the interspace between the support member 46 and the plate 32 defines a passage 49 for the flexible molds 16 therethrough, the member 46 defining a support for the molds during demolding thereof. The adjustment of the distance between the member 46 and the mold-receiving surface 32 allows using the system 10 for various thickness of molds 16.

Returning briefly to FIG. 2, the mounting assembly 56 will now be described in more detail.

The mounting assembly 56 includes a cylindrical rod 60, defining the axis 47, and that is rotatably mounted to both side plates 18 of the conveyor 16 therebetween via roller bearings 62. Each of the roller bearings 62 is secured to a respective plate 18 via a mounting plate 64. The support member 46 is secured to the rod 60, parallel thereto and for solidary movement therewith, via a couple of spacer arms 66, each secured to respective longitudinal ends of the rods 46 and 60.

The mounting assembly 56 further includes a couple of gap adjusting mechanisms 68 for adjusting and maintaining the distance between the rod 46 and the surface 32, depending on the thickness 58 of the molds 12.

Each of the gap adjusting mechanism 68 is secured to a respective side plate 18 and to the rod 46 therebetween and comprises a) a linear cylinder 70 that is secured via its main body 71 to a respective plate 18 via a mounting bracket 72, and b) a lever arm 74 that is secured to both rods 46 and 70 and pivotably mounted to the shaft 75 of the linear cylinder 70.

As a person skilled in the art will now appreciate, the distance between the rod 46 and the mold-receiving surface 32, can be adjusted by operating both linear cylinders 70 in unison.

According to the illustrated embodiment, the rod 46 is rotatably mounted to the spacer arms 66 so as to minimize friction onto the molds 12 when they exit the conveyor 16 through the interspace between the surface 32 and the rod 46.

Other mounting assembly than the assembly 56 can be provided to mount the rod 46 to the conveyor 26 and more specifically to maintain an operating distance between the rod 46 and the surface 32 so that the rod 46 forces onto the conveying surface 32 the portion of the molds 12 that has not yet exited the conveyor 16 during demolding.

According to another embodiment, a mechanical stop (not shown) is provided to limit the movement of the rod 46, such as on the cylinder 68 to limit its stroke. According to another embodiment (not shown), the rod 46 is mounted to the conveyor 16 so as to be positioned at a predetermined fixed distance from the surface 32.

According to still another embodiment (not shown), the support member 46 take another form than the illustrated rod, such as for example, a series of roller bearings mounted to a shaft or a plate (not shown) at a predetermined distance from the surface 32.

The robot 52 is in the form of a six (6) axes robot, such as, without limitations, those from the R-2000 series by Fanuc. According to another embodiment, the robot 52 has a different number than six operational axes and/or is from another manufacturer or type.

The pair of gripping tools 54 are attached to the robot 52 via a tooling mounting assembly 72. One of the gripping tools 54 will now be described in more detail with reference to FIGS. 1A, 1B and 3B.

Each of the gripping tools 54 comprises a pair of grippers 73, each comprising a mounting bracket 76 that mounts the gripping tool 54 to the assembly 72, a fixed jaw member 78 secured to the bracket 76, and a movable jaw member 80 that is mounted to the bracket 76 for pivotal movement towards and away the fixed jaw member 78. Each gripping tool 54 further comprises an actuating mechanism 82 between the movable jaw member 80 and the mounting bracket 76 for selectively closing the movable jaw members 80 onto the fixed jaw members 78.

The mounting bracket 76 generally defines a plane. The fixed jaw member 78 is in the form of an L-shaped member and includes a first portion 84 secured to the mounting bracket 76 so as to be parallel thereto, and a second portion 86 that extends from the first portion perpendicularly therefrom and that includes a friction pad 88 thereon.

The movable jaw member 80 includes a swivel arm 90 that is pivotably mounted to the mounting bracket 76 via a cylindrical shaft 92. The shaft 92 is rotatably mounted to the bracket 76, parallel thereto, via two roller bearings 94. The swivel arm 90 is fixedly mounted to the shaft 92 at a first longitudinal end thereof. A contact element 96, provided with a friction pad 98, is secured to the arm 90 perpendicularly therefrom.

The actuating mechanism 82 includes a linear cylinder 100 that is pivotably mounted to the mounting bracket 76 and a lever arm 102 that is secured, at one of its longitudinal end, to the shaft 104 of the linear cylinder 100 for pivotal movement about an axis 105 parallel to the shaft 92, and to the shaft 92 at its other longitudinal end.

In operation of the gripping tool 54, the linear cylinder 100 is actuated to move in unison the movable jaw members 80 towards or away the corresponding fixed jaw members 78, thereby allowing to grip or release a mold 12 by one of its edge 106.

While the gripping tools 54 are illustrated as each having a single actuating mechanism 82 and a pair of grippers 73, a different number of gripping tools and of actuating mechanism may be provided for each gripping tools 54. Also, the configuration of the grippers and or of the actuating mechanism may be different than illustrated. For example, both jaw members of the gripping tool 54 can be mobile.

A system for demolding a flexible mold 12 according to another embodiment (not shown) is equipped with another mold prehension mechanism than a gripping tool, such as, without limitations, vacuum pads, pins or hooks provided for cooperating with holes provided on the mold 12 (not shown), etc.

Further characteristics and features of the robots 52 will now be described with reference to the operation of the system 10 and to FIGS. 1A-1D, 3A-3D and 5.

Figure 3A:
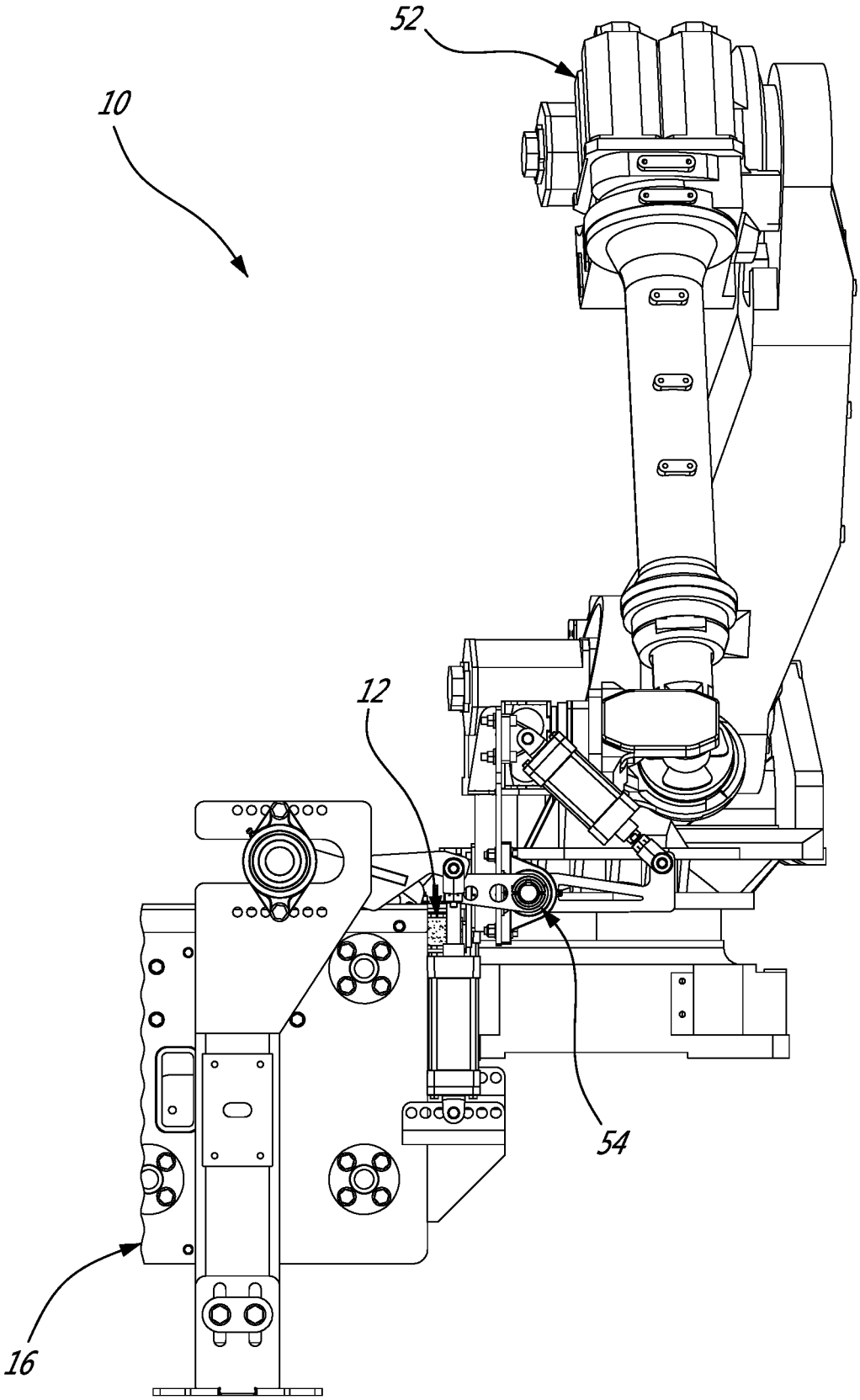
Figure 3B:
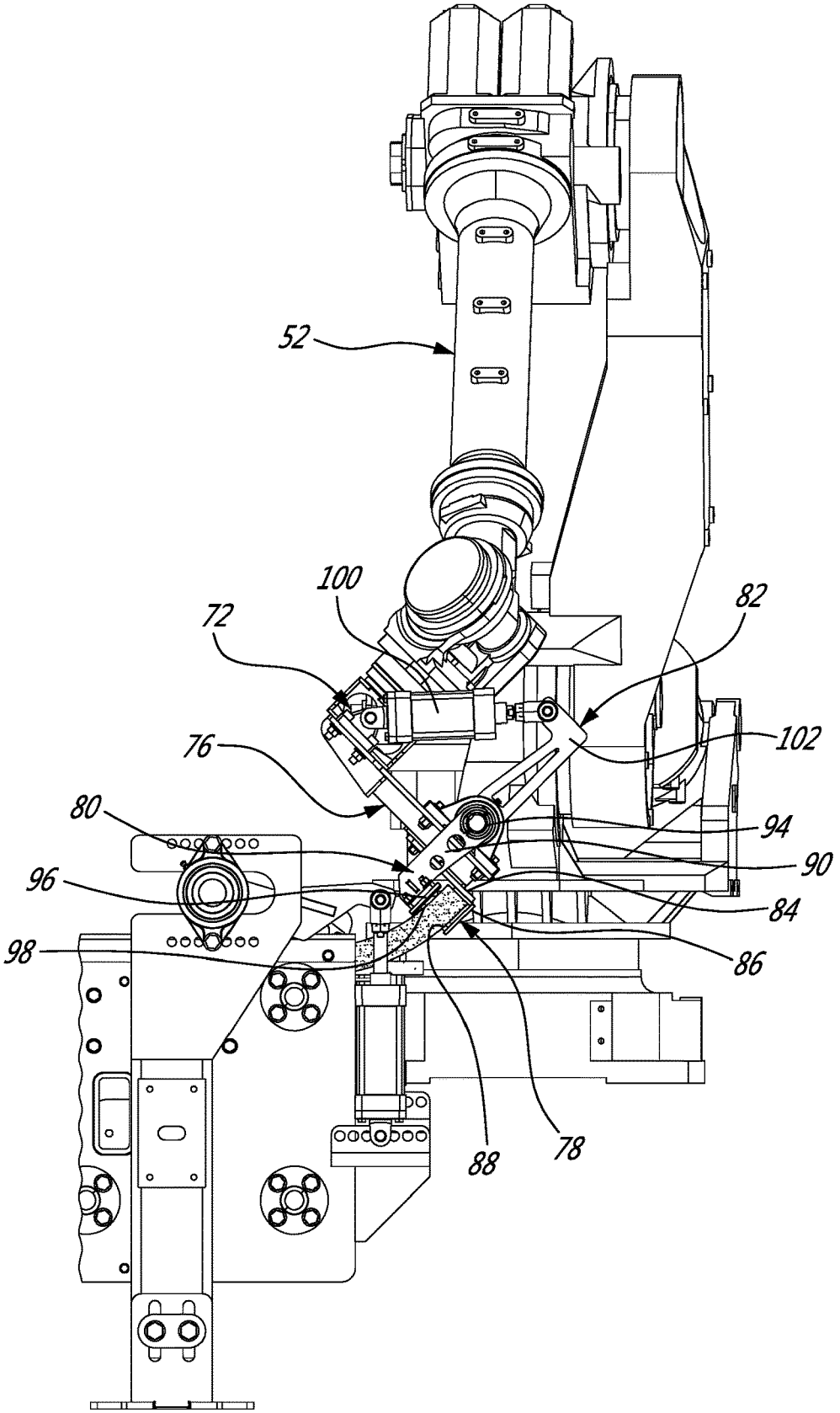

With reference first to FIGS. 1A and 3A, two flexible molds 12 of dried wet-cast concrete products 14 are moved side by side face down on the conveyors 16 by one of the pusher bar 34 until the front edges 106 of the molds 12 exit the passage 49 defined by the support member 46.

It is to be noted that the position of the molds 12 is indexed by the pusher bars 34. Depending on the products 14 or on the configuration of the molds 12, the system 10 can be operated so that the molds 12 are demolded while moving onto the conveyor 16 or while their movements are stopped.

According to another embodiment, the position of the molds 12 on the conveyor 16 is alternatively or complementarily indexed using sensors (not shown) or switches (not shown).

The pair of gripping tools 54 are then moved by the robot 52 in position to grip the molds 12 by their frontal edge. This position of the gripping tools 54 is shown in FIGS. 1A and 3A.

Figure 5:
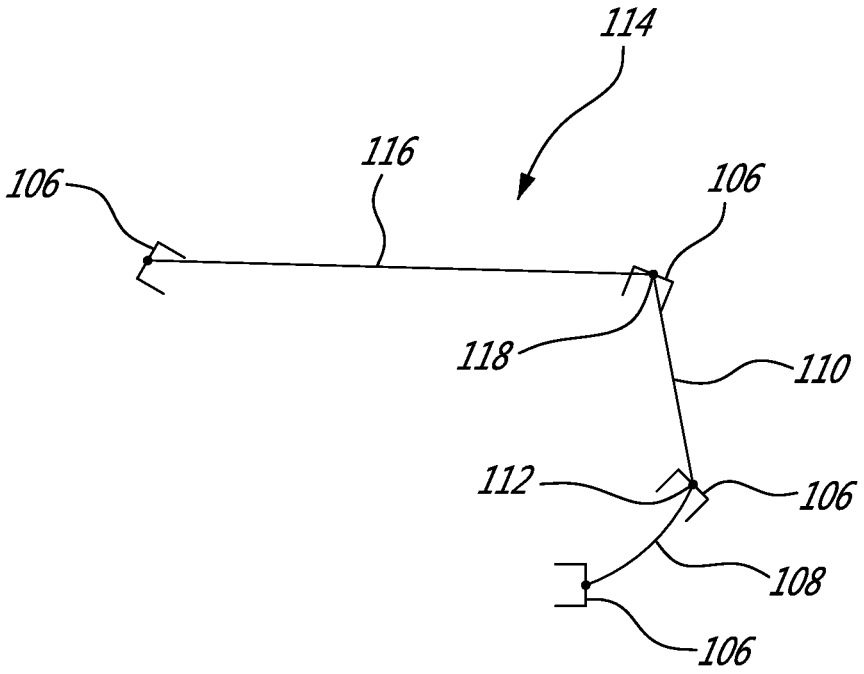
FIG. 5 is a graph illustrating the unsmooth path of an edge of the flexible mode during demolding thereof.

While the molds 12 remain firmly gripped by the gripping tools 54, the robot arm 52 is controlled such that the frontal edge 106 of each mold 12 is moved along a first arcuate path (see line portion 108 in FIG. 5). This movement has been found to crack the front portion of the molds 12, thereby easing the separation of the products 14 from the molds 12.

Figure 1C:
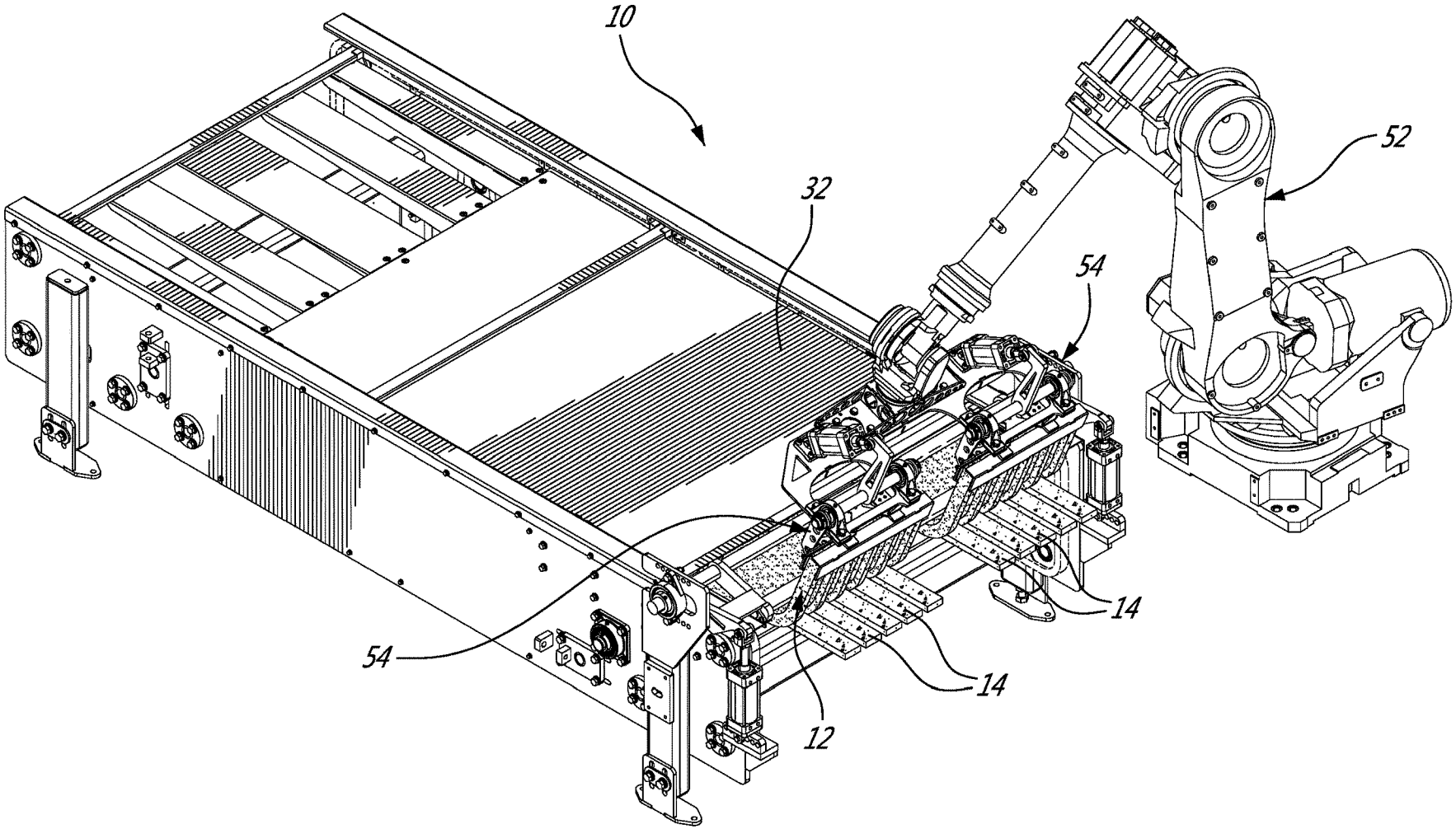
Figure 10:
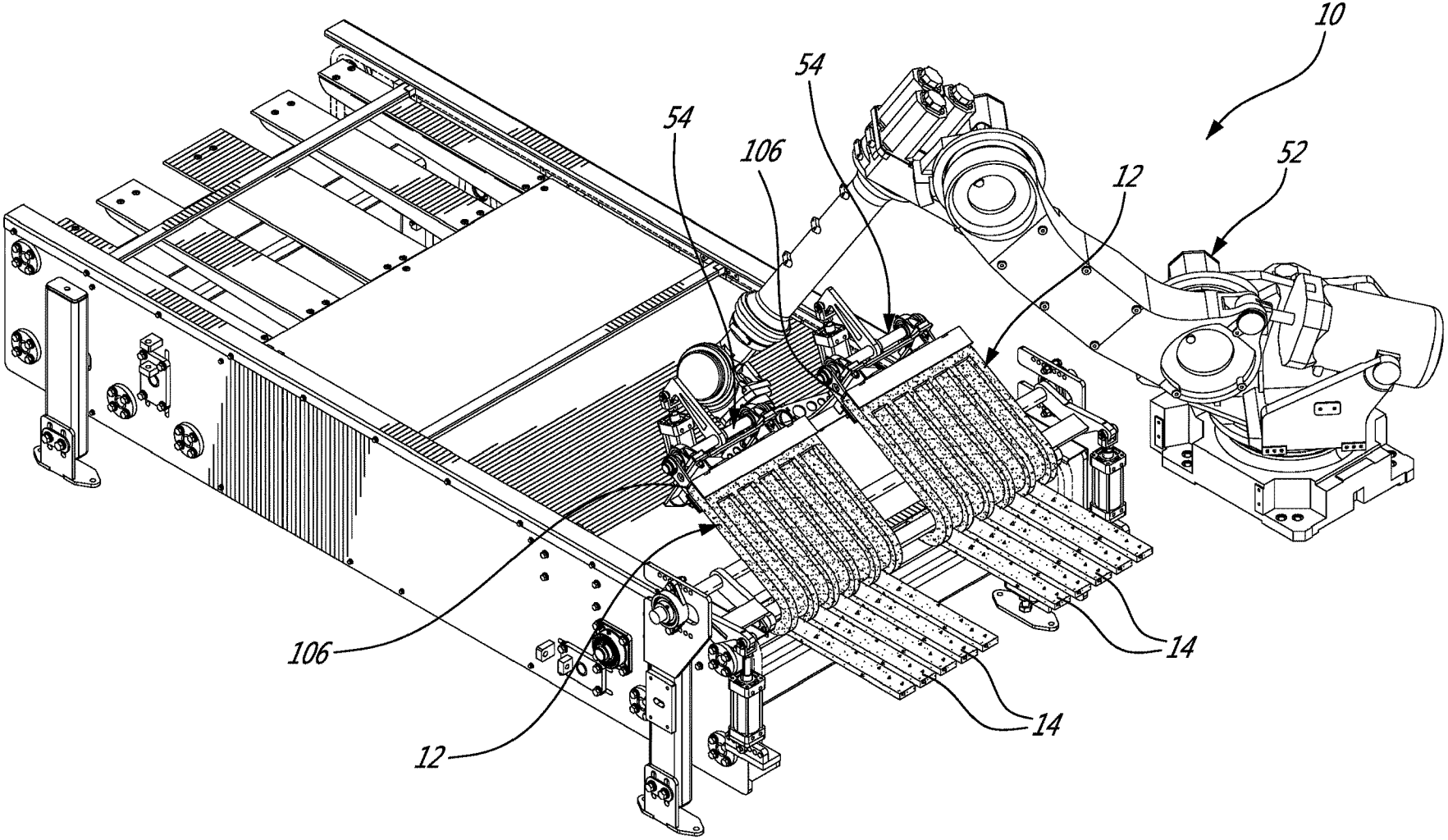
Figure 3C:
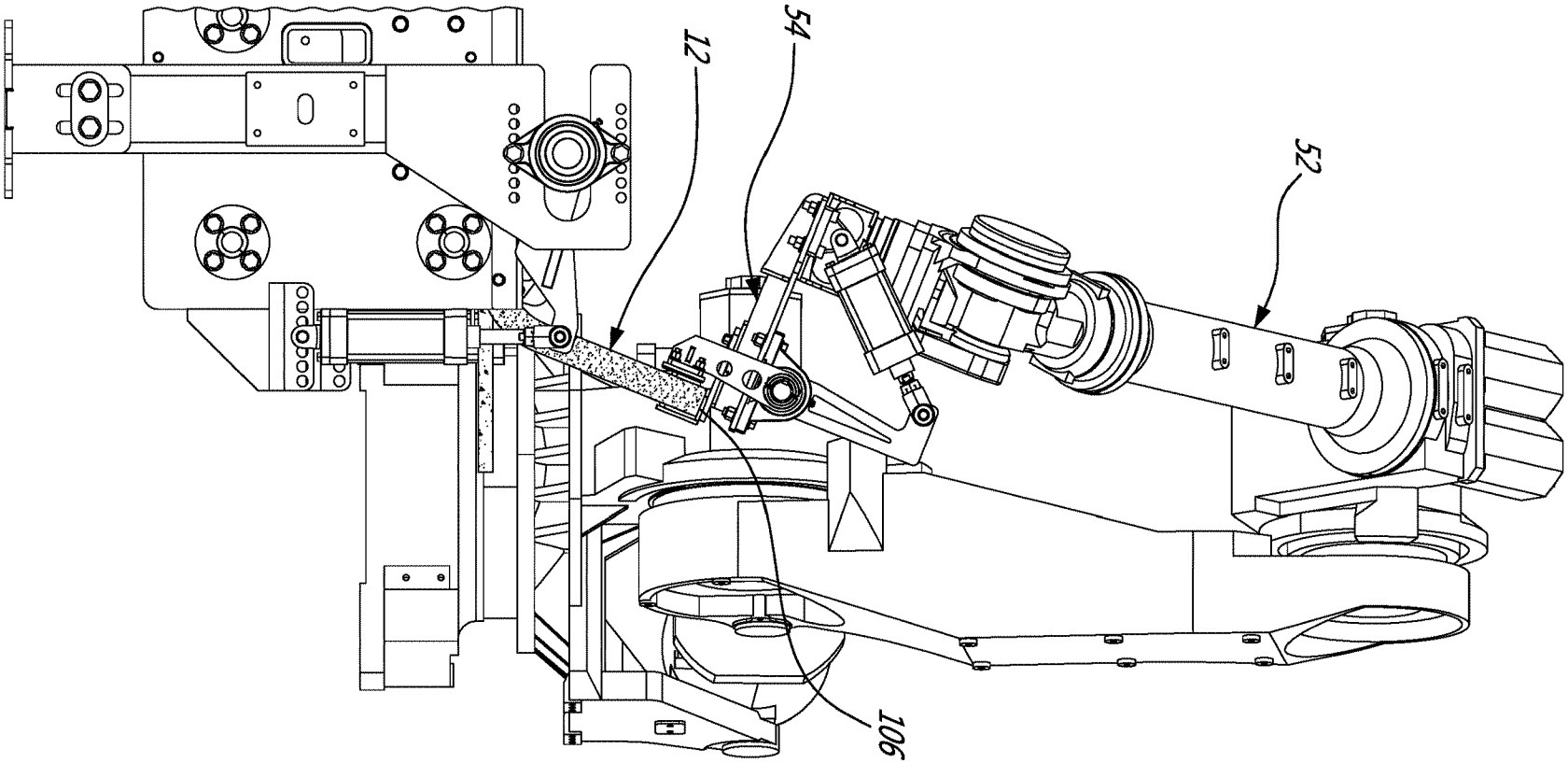
Figure 30:
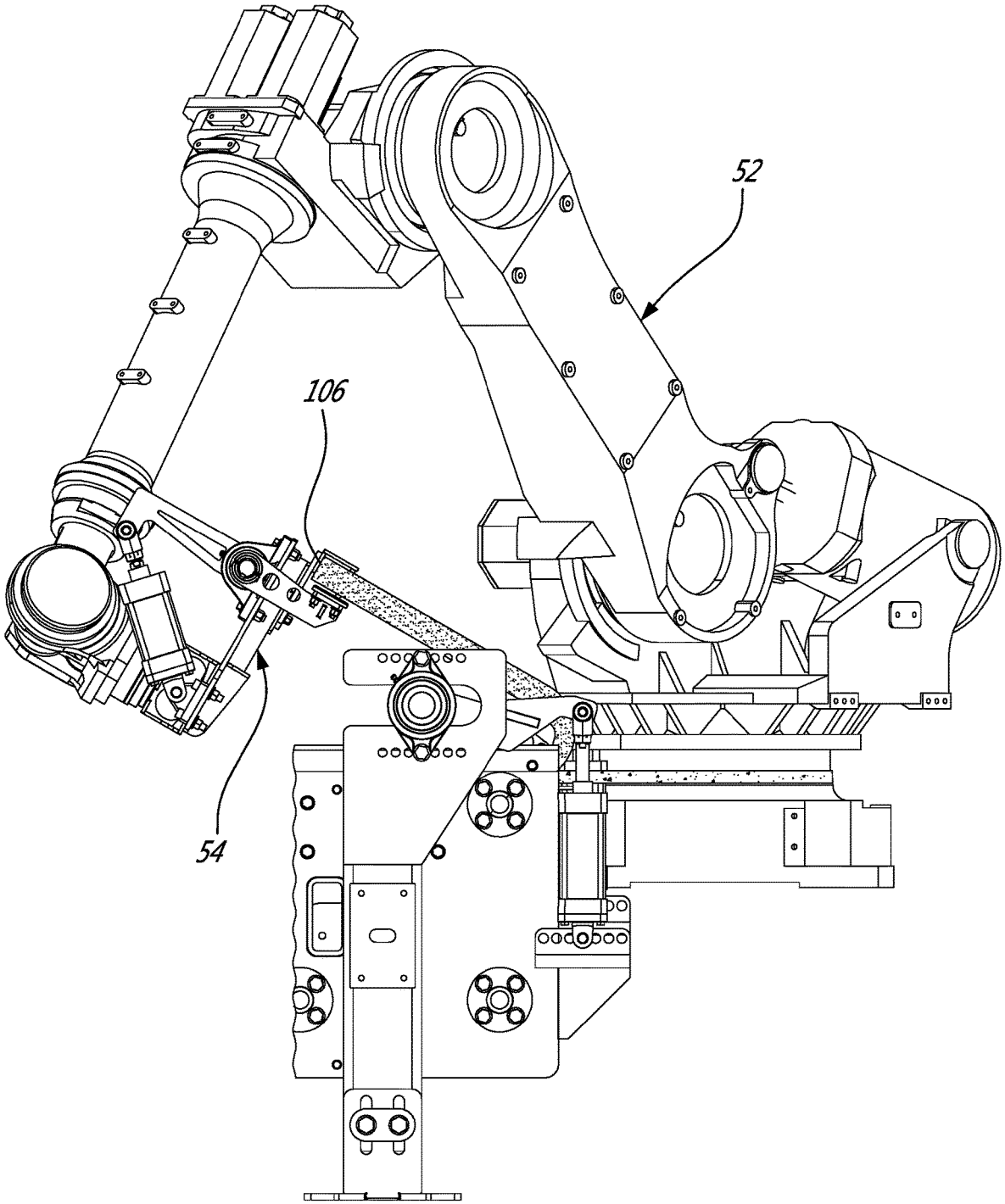

With reference to FIGS. 1C and 3C, the robot arm 52 is then operated so that the gripping tools 54 are pivoted rearward and then moved in a straight angled path upwardly (illustrated by line portion 110 in FIG. 5). This movement causes the lifting of the molds 12 while the products 14 remain on the conveyor surface 32.

As can be seen in FIG. 5, the change of path between paths 108 and 110 yields a first broken point 112 in the path 114.

It is to be noted that a further conveyor or another mold-receiving table (not shown) is provided adjacent the conveyor 16 downstream thereof to receive the first-partly-unmolded and then fully unmolded products 14.

With references to FIGS. 1D and 3D, the edges 106 of the molds 12 are then moved by the robot 52 rearwardly along a third path 116, yielding a second broken points 118 in the overall path 114, which can then be qualified as being unsmooth since it includes at least one broken point.

The demolding process then continues by the molds 12 being moved by the robot arm 52 away from the conveyor 16 and the demolded products 16 being convey away from the system 10 (both not shown).

The path 114 of the edges 106 of the molds 12 caused by the robot 52 is adapted to the configurations of the mold 12 and products 16 therein and the robot 52 can be operated so as to yield a different path for the edges 106 than the path 114.

For example, the path is not limited to be parallel the longitudinal direction and can include transversal movements.

It is to be noted that the path is the same for each part of the edge of a mold 12, all parts moving in unison.

Figure 6:
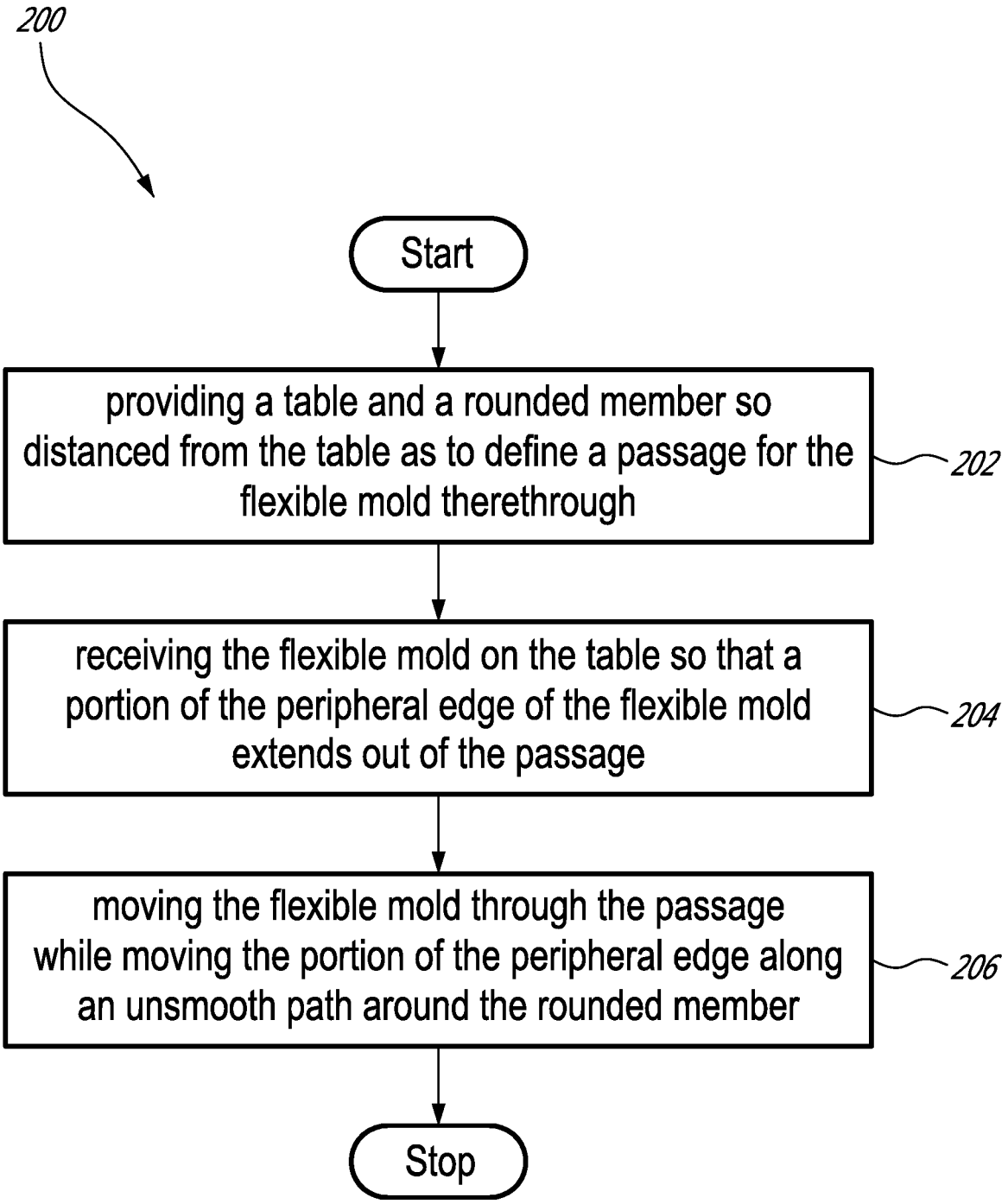
FIG. 6 is a flowchart of a method for demolding a flexible mold of dried wet-cast concrete products according to a first illustrative embodiment.

The method is summarized in FIG. 6.

It has been found that moving the flexible mold 12 along an unsmooth path that is adapted for the wet-cast concrete products configurations therein yields a more controlled demolding thereof and minimize both stucking of the products within the mold and damage of the products.

It is to be noted that connectors, cables, and other secondary or non-mechanical components of the system 10 have been omitted in the figures so as to alleviate the views.

It is to be noted that many modifications could be made to the method and system for demolding a flexible mold described hereinabove, for example:

- the robot 52 can be omitted and the gripping tools 54 be mounted to a track assembly (not shown) defining a path that guide there movement and orientation trough an unsmooth path as described hereinabove.

According to another embodiment of a method for demolding a flexible mold of wet-cast concrete products, the following step is performed prior to demolding:

- removing a vacuum on the flexible mold 12 by moving at least one portion of the peripheral edge 106 away from another portion of the flexible mold 12 that is adjacent to the at least one portion of the peripheral edge 106.

Figure 7:
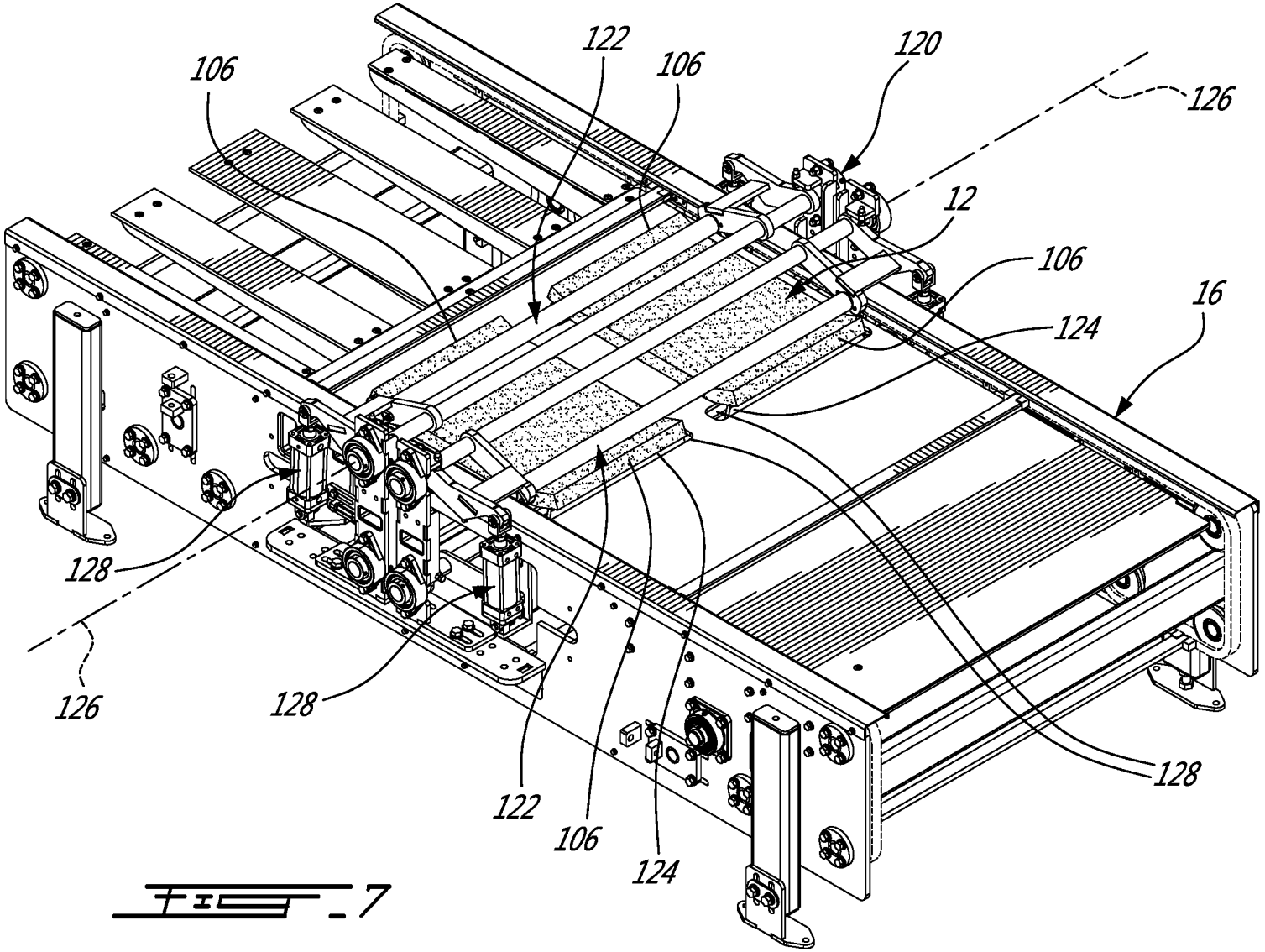
FIG. 7 is a top perspective of a conveyor similar to the conveyor of FIG. 1, further comprising a sub-system for cracking molds prior to their demolding according to a second illustrative embodiment.

This can be achieved, for example, by providing the subsystem 120 shown in FIG. 7.

The subsystem 120 comprises a pair of support members 122 that maintain the molds 12 unto the support plate 32 and a corresponding pair of mold-bending elements 124 (only one shown for each pair) that move both longitudinal edges 106 of the molds 12 away from the plate 32 while the molds 12 are maintained thereon.

Two independent pairs of a mold-bending element 124 with a corresponding support member 122 are provided and positioned on the conveyor 16 so as to independently and simultaneously bend both longitudinal edges 106 of the molds 12. According to another embodiment, a single pair of mold-bending element 124 and support member 122 is provided that cracks the molds 12 by bending their longitudinal edges 106 in consecutive passes therethrough or by bending a single one of the longitudinal edges 106, depending for example on the configuration and size of the molds 12 and/or of the products 14 therein.

The support member 122 is in the form of a cylindrical rod that is mounted to the conveyor 16 thereabove for pivotal movement about pivotal axis 126 via an actuating assembly 128. The axis 126 is parallel to both the plate 32 and the edges 106 of the molds 12 that are moved face down by the conveyor 16.

The mold bending elements 124 are in the form of blades that are mounted to the conveyor 16 for pivoting movement towards and away a mold-contacting position (shown in FIG. 7). Each of the four blades 124 is registered with a corresponding opening 128 in the plate 32 (only two shown) and has a length comparable, but slightly smaller, thereto so as to be movable in and out thereof. The openings 128 are positioned parallel to the axis 126 and are located so as to be registered with the longitudinal edges 106 of the molds 12, taking into account the length thereof.

As will now become apparent to a person skilled in the art, the actuation of the subsystem 120 causes the simultaneous i) extension of the blades 124 upwardly through the openings 128 and ii) movement of the support members 122 towards the plate 32 so as to maintain the molds 12 thereon in close contact with the plate 32. It results from such movements that the longitudinal edges 106 of the molds 12 are moved upwardly away from the plate 32, while portions of the molds 12 that are longitudinally adjacent to the edges 52 are maintained onto the plate 32. This removes vacuum between the molds 12 and products 14 and therefore the adherence therebetween, thereby facilitating the removal of the products 14 during demolding.

The actuation of the subsystem 120 is synchronized with the passage of the molds 12 along the conveyor 16, the position of the molds 12 being indexed by the pusher bars 34. Depending on the products 14 or on the configuration of the molds 12, the system 10 can be operated so that the molds 12 are cracked while moving onto the conveyor 16 or while their movements are stopped.

It is to be noted that many modifications could be made to the method and sub-system for cracking a flexible mold described hereinabove, for example:

- the method and system are not limited to cracking molds 12 at their longitudinal side edge; the system can be modified, including the orientation of the blades 124 and openings 128, so that the molds 12 are cracked alternatively or complementarily at their lateral sides;
- the blades 124 can be substituted with a plurality of fingers or plungers (not shown) and the elongated openings 128 can be replaced by a series of holes (not shown) in the plate 32;
- the support members 122 can take other form or be omitted;
- instead of members that pushes the edges 106 of the molds 12 upwardly, the mold-bending mechanism can be configured to move the edges 106 downwardly. For example, the mold-bending mechanism can be in the form of one or more grabbing members (not shown) that pull the edges 106 of the molds 12 downwardly while the edges 106 are positioned above an opening in the conveying surface;
- the mold-bending mechanism can be adapted to bend the molds 12 while they are face up on the table;
- while the support members 122 are movable between deployed and retracted positions, they can be modified so as to be fixedly mounted to the conveyor 16.

Although a method and system for demolding a flexible mold of dried concrete products have been described hereinabove by way of illustrated embodiments thereof, they can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A method for demolding at least one flexible mold that is at least partially filled with dried wet-cast concrete products and that has a front edge; the method comprising:

providing a table and a mold-support member so distanced from the table as to define a passage for the at least one flexible mold therethrough; the mold-support member being rotatable about an axis parallel to the passage to minimize friction in the passage;

receiving the at least one flexible mold on the table so that the front edge extends out of the passage; and moving the at least one flexible mold through the passage while moving the front edge along an unsmooth path about the mold-support member.

2. The method as recited in claim 1, wherein the at least one flexible mold includes a plurality of flexible molds.

3. The method as recited in claim 2, further comprising moving the plurality of flexible molds side by side on the table until the front edge of each of the plurality of flexible molds extends out of the passage.

4. The method as recited in claim 1, wherein the at least one flexible mold is made of a rubber or polyurethane.

5. The method as recited in claim 1, wherein at least two of the dried wet-cast concrete products are differently shaped.

6. The method as recited in claim 1, wherein the unsmooth path includes a plurality of broken points.

7. The method as recited in claim 1, wherein the front edge is part of a peripheral edge of the at least one flexible mold; the method further comprising, prior to said receiving the at least one flexible mold on the table so that a portion of the peripheral edge extends out of the passage, removing a vacuum on the at least one flexible mold by moving at least one portion of the peripheral edge away from another portion of the at least one flexible mold that is adjacent to the at least one portion of the peripheral edge.

* * * * *